United States Patent [19]

Prince et al.

[11] Patent Number: 4,811,417

[45] Date of Patent: Mar. 7, 1989

[54] HANDLED BAG WITH SUPPORTING SLITS IN HANDLE

[75] Inventors: Carlton C. Prince, Hartwood; James J. Graboski, Locust Grove, both of Va.

[73] Assignee: Trinity Paper & Plastics Corp., New York, N.Y.

[21] Appl. No.: 140,819

[22] Filed: Jan. 5, 1988

[51] Int. Cl.[4] ..... B65D 33/10

[52] U.S. Cl. ..... 383/9; 206/554; 206/806; 383/8; 493/204

[58] Field of Search ..... 206/554, 806; 383/8, 383/9; 493/204, 203

[56] References Cited

U.S. PATENT DOCUMENTS

| | | | |
|---|---|---|---|
| 3,317,037 | 5/1967 | Russell | 706/493 X |
| 3,797,732 | 3/1974 | Melin et al. | 383/9 |
| 4,406,371 | 9/1983 | Membrino | 206/554 |
| 4,493,419 | 1/1985 | Prader et al. | 206/554 |
| 4,529,090 | 7/1985 | Pilon | 206/554 |
| 4,676,378 | 6/1987 | Baxley et al. | 206/554 |

FOREIGN PATENT DOCUMENTS

| | | | |
|---|---|---|---|
| 1958690 | 5/1971 | Fed. Rep. of Germany | 206/554 |

*Primary Examiner*—David T. Fidel
*Assistant Examiner*—Bryon Gehman
*Attorney, Agent, or Firm*—Darby & Darby

[57] ABSTRACT

A plurality of bags, each having an upright handle at either lateral edge thereof, is formed into a bag-pack, and the bag-pack is retained on a supporting rack by providing upright slits in the handles of each bag through which arms of the supporting rack extend. Unlike holes which are formed in the bag handles, upright slits do not cause weakening of the handles. In addition, the stacked handles of the bags are punched with a heated pin having a diameter no larger than approximately three thirty-seconds of an inch, to weld together the stacked handles of the bags, thereby permitting convenient mounting of the stacked handles on the arms of the supporting rack, without substantially weakening the bag handles. The individual bags are readily detachable from the bag-pack, because the pin is uniformly heated by being placed in a passageway in a block of metal heated to a temperature in the range of about 250°-260° F. The block passageway is long enough to receive at least a forward portion of the pin corresponding in length to approximately the stacked height of the bag-pack.

3 Claims, 2 Drawing Sheets

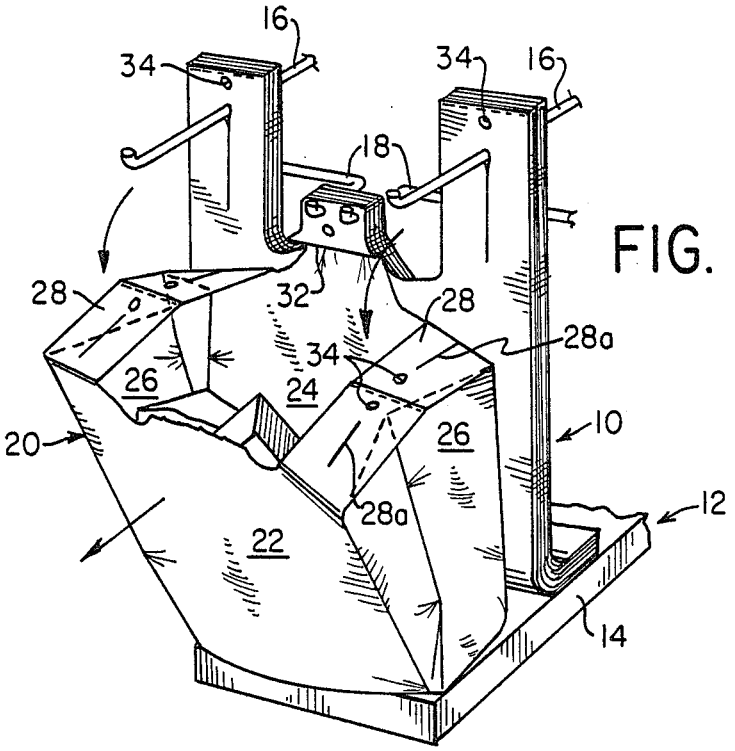
FIG. 4
FIG. 5
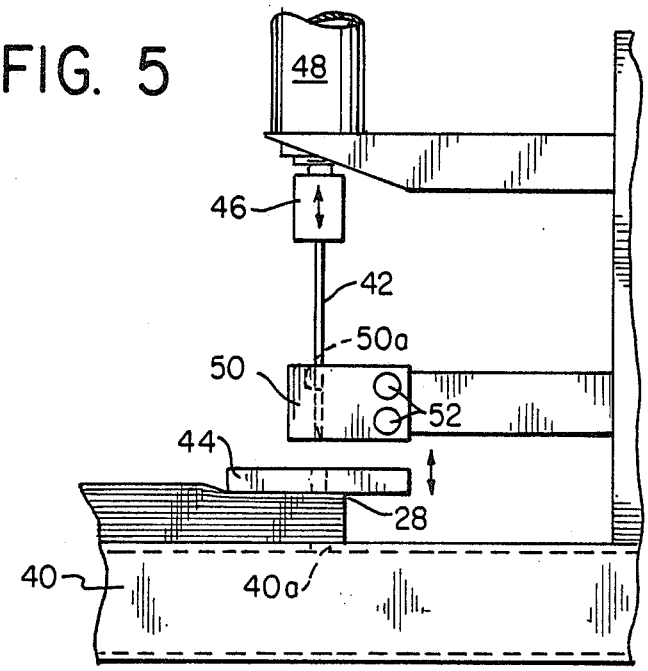

HANDLED BAG WITH SUPPORTING SLITS IN HANDLE

FIELD OF THE INVENTION

The present invention relates generally to bags and, more particulary, concerns a plastic bag construction, a bag-pack utilizing the same, and a method for manufacturing the bag-pack.

BACKGROUND OF THE INVENTION

Bags made of plastic sheet material have gained wide acceptance for use in supermarkets. Such bags are preferred because of their high strength, light weight, moisture resistance and relatively low cost. However, the plastic sheet material from which such bags are made exhibits very little stiffness, so that a plastic shopping bag cannot be filled in the same manner as a paper one (i.e. by standing the bag up in an open position). It has therefore become the standard practice, with plastic shopping bags, to utilize some form of stand to support the bag while it is being filled. However, the use of supporting racks has introduced a whole series of problems of its known.

In order to use a bag rack effectively, each of the bags should be flat, and a stack of bags should be formed into a "bag-pack" for mounting on the rack. Individual bags can then be removed from the mounted bag-pack and filled until all the bags in the bag-pack are used up, at which time a new bag-pack is mounted on the rack.

One well-known type of plastic shopping bag is the so-called handle bag, which consists of flat front and rear surfaces joined by a gusset at either lateral edge and a handle portion projecting upwardly on either edge of the front and rear surfaces. In order to form a bag-pack, each bag is provided with a detachable tab portion between the two handles, and the stack of bags forming the bag-pack is joined by sealing the tabs together, for example, by driving a heated pin through the tabs. A bag-pack is mounted on the supporting rack by providing means for supporting the joined tabs, and separate arms are provided for supporting each of the bag handles. Typically, holes are punched through each of the bag handles so as to permit them to be placed on forwardly projecting arms positioned on the supporting rack, with each arm extending through the holes in one stack of bag handles. Although this makes it convenient to load a bag by sliding it forward on the arms, such bag and bag-pack construction suffer from two major shortcomings.

First of all, punching holes through the bag handles tends to weaken the handles. When the bags are filled to the degree that is common in supermarkets, the weight of the contents causes tears to develop in the handles which emanate directly from stress points in the holes. Usually, the handles on such a bag will tear under normal loading conditions, while it is being carried by a shopper. This is particularly likely if the bag is made of a low density plastic sheet material, which is now common.

A second problem encountered with bag-packs of this type is that they can only be mounted on the supporting rack if the stacked handles of the bags are retained together. Otherwise, the handles separate while the attendant is mounting the bag-pack on the rack, and it becomes inconvenient and tedious to place the individual handles on the supporting arms. However, it is not enough that the handles be joined, since it also necessary that the handles of a bag separate readily from the bag-pack once it is filled. It has been suggested that the handles on each side of a bag-pack be provided with detachable portions which are joined together in the same manner as the bag tabs (see, for example, U.S. Pat. No. 4,676,378, granted to W. H. Baxley, et al. on June 30, 1987). However, this introduces additional steps which complicate the manufacturing process and make it more expensive.

Broadly, it is an object of the present invention to provide a plastic bag and bag-pack which avoid the shortcomings of prior art articles of this type. It is specifically contemplated that the bag-pack be capable of being conveniently mounted on a supporting rack so that the individual bags will be held in position on the rack while being filled, without weakening the handles of the bag.

It is also an object of the present invention to provide a method for manufacturing a bag-pack of the type described.

It is yet another object of the present invention to provide a bag and bag-pack which are convenient and reliable in use, yet relatively inexpensive to manufacture.

In accordance with the present invention, a plurality of bags, each having an upright handle at either lateral edge thereof, is formed into a bag-pack, and the bag-pack is retained on a supporting rack by providing upright slits in the handles of each bag. The applicants have found that, unlike holes which are formed in the bag handles, upright slits do not cause weakening of the handles. As used herein, the term "slit" will be understood to be a cut placed in the material of the bag which causes separation of the material, but does not remove material. In addition, it has been found that, if the handles of the bags comprising a bag-pack are punched with a heated pin having a diameter no larger than approximately three thirty-seconds of an inch, the handles of the bags comprising the bag-pack will be welded together sufficiently to permit convenient insertion of the arms of the supporting rack through the slits in the bag handles, without substantially weakening the bag handles. At the same time, the individual bags will be readily detachable from the bag-pack, after being filled, if the pin is heated by being placed in a passageway in a block of metal heated to a temperature in the range of about 250°-260° F. The passageway should be long enough to receive at least a forward portion of the pin corresponding in length to approximately the stacked height of the bag-pack.

BRIEF DESCRIPTION OF THE DRAWINGS

The foregoing brief description, as well as further objects, features and advantages of the present invention will be understood more completely from the following description of presently preferred, but nonetheless illustrative, embodiments in accordance with the invention, with reference being had to the accompanying drawings in which:

FIG. 4 is a perspective view similar to FIG. 3 showing the bag after it has been filled, with the bag handles removed from the rack and the tab portion on the rear wall of the front bag ready to be detached from the bag-pack; and FIG. 5 is a side view showing how the arms of a bag-pack are punched to detachably weld them together for convenient mounting of the bag-pack on the supporting rack.

DETAILED DESCRIPTION OF PREFERRED EMBODIMENTS

Figure 1:
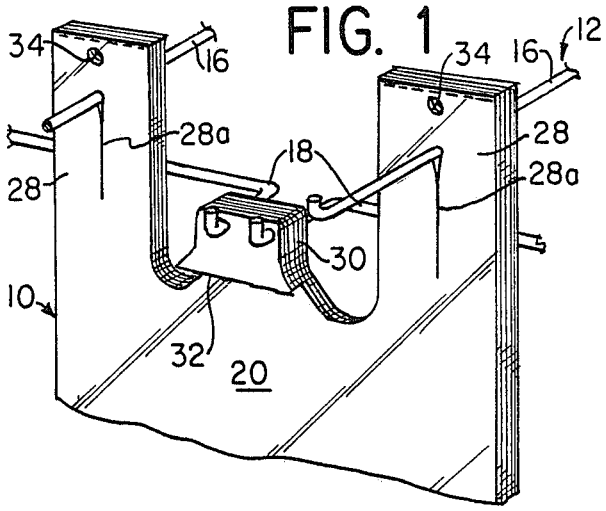
FIG. 1 is a fragmentary perspective view showing a bag-pack in accordance with the present invention mounted on a supporting rack with all of the bags attached together at each handle and at an intermediate tab portion.
Figure 2:
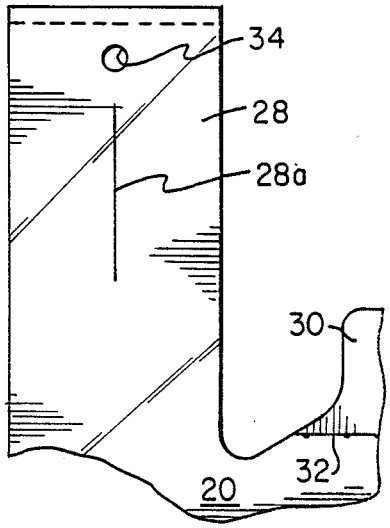
FIG. 2 is a fragmentary front view with respect to FIG. 1 showing the handle of an individual bag on an enlarged scale.

Turning now to the details of the drawings, there is illustrated a bag-pack 10 which is shown mounted in its position of use on a supporting rack 12. As is conventional, supporting rack 12 has a base 14, a pair of supporting arms 16, 16 mounted at a distance above the base by conventional means (not shown) and mounting fingers 18, 18, are also mounted at a distance above the base by conventional means (not shown).

Bag-pack 10 is made up of a plurality of superimposed plastic bags 20 in a stacked arrangement. Each bag 20 is made of a plastic sheet material and is of the well-known type including a front wall 22 and a rear wall 24 joined by a gusset portion 26 at either lateral margin of the bag. Along either lateral margin of the bag, carrying handles 28, 28 extend upwardly as extensions of the walls 22, 24 and the gusset portions 26, 26. Each bag 20 also includes an upwardly projecting, tab portion 30, which is attached to the bag between the handles, by means of a perforation 32.

Figure 3:
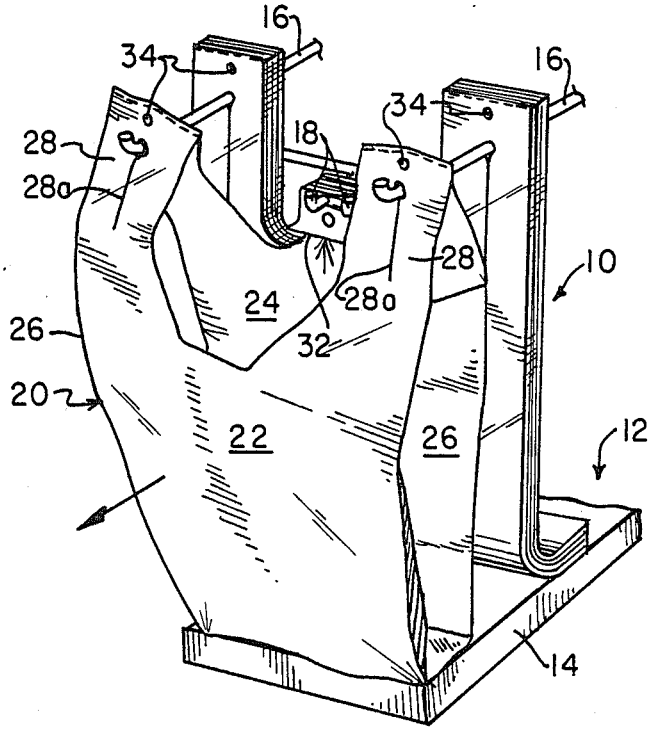
FIG. 3 is a perspective view illustrating a bag-pack mounted on a supporting rack, with the front bag of the bag-pack pulled forward to a in position to be filled, the handles of the forward bag being detached from the bag-pack.

In use, after bag-pack 10 has been mounted on rack 12, the front of the forward most bag is detached from tab portion 30 of the bag-pack, and the bag is slid forward along arms 16, 16 into an opened position, for filling (see FIG. 3). After the bag is filled, the handles 28, 28 are removed from the arms 16, 16, and a slight forward pull on the bag causes the rear of the bag to be detached from tab portion 30 of bag-pack 10. The filled bag 20 may then be carried away from the bag rack, making use of handles 28, 28.

The applicants have found that punching holes in bag handles 28, 28 for the purpose of mounting bag-pack 10 on arm 16, 16 weakens the bag handles, to the point where they will fail in normal use, for example, while the customer is carrying a filled bag out of a supermarket. This is particularly true of bags made of low density plastic sheet material, which is widely used for bags today. In order to determine the acceptability of a particular bag construction, the applicants have devised a test to determine whether the handles will fail during normal use. For the purposes of the test, a bag is filled with a 25 pound weight and is suspended from a carrier supporting the handles at the top on a machine which oscillates the bag up and down for one minute at about a one cycle per second rate. Utilizing this test, the applicants have found that the handles in conventional bags made from a low density plastic sheet material will fail if holes are provided in the bag handles which are sufficiently large to permit the bag-pack to be mounted on arms 16, 16 of rack 12.

However, when slits are placed in the bag handles, as illustrated in the drawings, the bags easily pass the test. Naturally the slits must be long enough to permit arms 16, 16 to pass through (about half an inch), and they should be kept as short as possible. Slits as long as about two inches can be used conveniently, without weakening the bag handles to the point where they fail the test. The slits can be formed by punching a sharp blade, such as a knife, through the stacked handles.

As can be seen in the drawings, the bags comprising bag-pack 10 are joined together near the top of either handle 28, 28 by means of a weld 34, 34. By joining the bag handles together in this manner, it is possible to mount stacked handles on a respective arm 16 as a unit, which makes for convenient mounting of bag-pack 10 on rack 12. However, proper use of the bag requires tat the handles of the forward bag be readily detachable from the bag-pack, in order to permit filling, as shown in FIG. 3. Such detachment of the forward bag must not only be convenient, but it must be accomplished without tearing the handles of any of the bags, in order to avoid failure of the bags.

Conventionally, welds similar to welds 34, 34 would be made by forcing a hot pin through the stacked handles of the bags when forming bag-pack 10. However, conventional methods for forming such welds have proved ineffective. First of all, the welding process itself produces a hole in the bag handles, and this tends to weaken the handles. It has been found that, if the bag handles are welded with a pin larger than about three thirty-seconds of an inch in diameter, the bag handles are likely to fail in use. Moreover, it has also been found that a pin having a diameter of less than about one sixteenth of an inch would not be sufficiently strong for use in a manufacturing environment.

In addition, the conventional pin welding technic has proved ineffective for securing the bag handles. Specifically, it has proved impossible to control the temperature of a conventional, electrically heated welding pin to an adequate degree to reliable welds. If the pin is heated to a temperature that will permit the rearmost bags of the bag-pack to be detachably secured, then the bags at the front of the bag-pack are heated excessively and cannot be separated readily without damaging the bag handles. On the other hand, if the pin is heated to a temperature that will permit the front bags of a bag-pack to be detachably secured, reliable securement of the bags at the rear of the bag-pack cannot be achieved.

The preferred process for forming the welds in bag handles 28, 28 is illustrated in FIG. 5. The bag-pack 10 is supported on a base 40 so that the superposed, stacked bag handles 28 may be welded with a heated metal pin 42. The base 40 includes an aperture under bag-pack 10 which is dimensioned to receive pin 42, and the stripper plate 44 is provided immediately above the bag-pack. Pin 42 is mounted in a conventional pin holder 46 which is, in turn, received in a conventional air cylinder 48 for vertical movement.

Pin 42 is preferably between 1/16 and 3/30 seconds of an inch in diameter. Appropriate heating of pin 42 is achieved by passing it through a passage way **50*a* in a steel block 50. Preferably, the steel block is approximately 1 inch high and passage 50*a* is approximately 1/32 of an inch larger than the diameter of pin 42. By means of heaters 52, for example electrical cartridge heaters, block 50 is heated to a temperature which is closely regulated to remain in the range of approximately 250°–260° F. In use, pin 42 is permitted to come up to the temperature of the block 50, before it is pressed into the bag-pack 10**.

When the process of FIG. 5 is utilized, a lower portion of pin 42 corresponding to approximately the thickness of the bag-pack is heated to a substantially uniform, closely regulated temperature in the range of approximately 250°–260° F. When the bag-pack is welded with this pin, the handles of all of the bags in the bag-pack are detachably secured, and this securement is both consistent and reliable.

Although preferred embodiments of the invention have been disclosed for illustrative purposes, those skilled in the art will appreciate that many additions, modification and substitutions are possible, without departing from the scope and spirit of the invention as defined in the accompanying claims.

What is claimed is:

1. In a bag of the type manufactured from plastic sheet material so as to form front and rear walls, said walls having lateral margins corresponding with the lateral margins of said bag, and a handle extending upwardly near each lateral margin of said bag as an extension of said front and rear walls, the improvement comprising each handle being provided with an upright, substantially straight slit extending along the handle to permit mounting of each bag handle on a protruding arm of a supporting rack.

2. In combination, a plurality of bags each in accordance with claim 1, said bags being arranged in superposed, stacked alignment, to form a stack of bag handles along either lateral margin of said bag-pack, each stack of bag handles being joined by means of a pin weld extending therethrough.

3. A plurality of bags of the type manufactured from plastic sheet material so as to form front and rear walls, said walls having lateral margins corresponding with the lateral margins of said bag, and a handle extending upwardly near each lateral margin of said bag as an extension of said front and rear walls, each bag handle being provided with an upright, substantially straight slit extending along the handle to permit mounting of each bag handle on a protruding arm of a supporting rack, said bags being arranged in superposed, stacked alignment, to form a stack of bag handles along either lateral margin of said stacked bags, each stack of bag handles being joined by means of a pin weld extending therethrough to form a bag-pack, said bag-pack, in which the bags are detachably secured, having been formed by the method comprising the steps of:

arranging said plurality of bags in superposed, stacked alignment;

heating said pin by inserting it in an elongated passageway in a heated metal block, the length of said passageway being approximately equal to the stacked height of said bags; and pressing said pin through said aligned bags to form a pin weld therein.

* * * * *